US007341079B2

(12) United States Patent
Zanga

(10) Patent No.: US 7,341,079 B2
(45) Date of Patent: Mar. 11, 2008

(54) MACHINE FOR THE ASEPTIC TREATMENT OF CONTAINERS IN BOTTLING PLANT

(75) Inventor: Francesco Zanga, Parma (IT)

(73) Assignee: Sidel Holdings & Technology SA, Geneva (CH)

( * ) Notice: Subject to any disclaimer, the term of this patent is extended or adjusted under 35 U.S.C. 154(b) by 282 days.

(21) Appl. No.: 10/542,417

(22) PCT Filed: Jan. 30, 2003

(86) PCT No.: PCT/IT03/00035

§ 371 (c)(1),
(2), (4) Date: Jul. 15, 2005

(87) PCT Pub. No.: WO2004/065283

PCT Pub. Date: Aug. 5, 2004

(65) Prior Publication Data

US 2006/0059862 A1 Mar. 23, 2006

(30) Foreign Application Priority Data

Jan. 17, 2003 (IT) ..... PR2003A0001

(51) Int. Cl.
*B65B 1/04* (2006.01)

(52) U.S. Cl. ..... 141/92; 141/85; 141/89; 141/145; 53/282

(58) Field of Classification Search ..... 141/85–95, 141/144–147; 53/167, 201, 282
See application file for complete search history.

(56) References Cited

U.S. PATENT DOCUMENTS

| | | | | |
|---|---|---|---|---|
| 3,105,335 | A | 10/1963 | Hickey | |
| 3,356,510 | A * | 12/1967 | Barnby | 426/399 |
| 3,536,370 | A * | 10/1970 | Harris-Smith et al. | 312/1 |
| 3,757,622 | A * | 9/1973 | Berry | 83/165 |
| 3,799,220 | A | 3/1974 | Berry et al. | |
| 5,031,673 | A * | 7/1991 | Clusserath | 141/6 |
| 6,082,418 | A * | 7/2000 | Naecker et al. | 141/145 |
| 7,121,062 | B2 * | 10/2006 | Till | 53/167 |

FOREIGN PATENT DOCUMENTS

GB 407672 A 3/1934

* cited by examiner

*Primary Examiner*—Timothy L. Maust
(74) *Attorney, Agent, or Firm*—Pearne & Gordon LLP

(57) ABSTRACT

Machine for the aseptic treatment of containers (10) in bottling plant, of the rotary type provided with a plurality of stations (9) for treating the containers and so shaped as to cause the treatment of the containers to take place under substantially sterile conditions, is characterised in that it comprises sealing means that separate a non sterile area (11) of the machine from an area (12) maintained under sterile conditions and in which the treated containers (10) transit, said means comprising a fixed annular channel (15) at least partially filled with liquid in which slides a concentric annular element (16) associated with the rotating part (11).

10 Claims, 5 Drawing Sheets

MACHINE FOR THE ASEPTIC TREATMENT OF CONTAINERS IN BOTTLING PLANT

CROSS-REFERENCE TO RELATED APPLICATION

This application is a National Stage entry of International Application No. PCT/IT2003/000035, filed Jan. 30, 2003, the entire specification claims and drawings of which are incorporated herewith by reference.

TECHNICAL FIELD AND BACKGROUND ART

The present invention relates to a machine for the aseptic treatment of containers in bottling plant.

In plants for bottling and packaging containers for drinks (e.g. bottles) under aseptic conditions, to prevent contamination the container treatment area (for instance in the sterilizer, rinsing machine, filling machine, capping machine) must be duly isolated from the exterior environment and maintained sterile.

According to a first constructive solution, the various machines of the plant (e.g. sterilizer, rinsing machine, filling machine, capping machine) are totally inserted inside voluminous aseptic chambers kept in overpressure conditions relative to the exterior environment by using fans to inject air filtered by absolute filters, which then has a unidirectional outward flow in correspondence with the openings required for the entry/exit of the containers into/from the chambers in which the machines and the components of the plant are inserted. In this way, the possible entrance of micro-organisms into the container treatment area is prevented.

However, since the dimensions of the machines, which are generally rotary, are considerable, the dimensions of the aseptic chambers are so large as to make it difficult to manage them and to maintain sterile conditions.

According to another solution, to reduce the size of the chambers, only the process areas of the machines are isolated, leaving the remaining part of the machines in an uncontrolled atmosphere.

In rotary machines, the process area to be isolated is defined between a rotating part and a fixed part, and a barrier is required between the rotating part, in which the process organs are mounted (for instance the sterilizing nozzles of a sterilizer, or the filling valves of a filling machine, or the closing heads of a capping machine, . . . ) and the fixed walls, such as the protective casing towards the exterior of the machine or towards the transmission organs.

For this purpose, gaskets made of elastomeric material have been used, generally applied to the rotating part, which slide on the normally metallic fixed part.

Considering that the main conditions of reliability of the solution (smooth, hard sliding surface with low friction coefficient and parallel to the gasket; low sliding speeds) contrast with the considerable dimensions of the machines that prevent, due to the required work process tolerances and production rates, the achievement of these conditions, it is readily apparent that the main drawbacks of this solution are due to the rapid wear of the gasket with consequent loss of seal.

Another known solution provides for the use of labyrinth seals, which overcome the gasket wear problems because they do not imply any physical contact between the parts in relative motion.

However, the quality of the seal depends on the distance between the moving parts: as said distance decreases, seal quality increases, but achieving reduced distances (i.e. tens of millimeters) is particularly complex and costly in such large machines because the tolerances of the mechanical work processes are such as to make it difficult to attain such small distances.

With this solution, moreover, another possible path for the exchange of air with the exterior environment is given by the labyrinth seals and therefore, to obtain an adequate overpressure a greater flow rate of sterile air is necessary, with higher costs and with the danger of a lack of isolation.

DISCLOSURE OF THE INVENTION

The aim of the present invention is to eliminate the aforesaid drawbacks, making available a machine for treating containers in which the container treatment area is isolated from the exterior environment in an extremely simple and economical manner.

Said aims are fully achieved by the machine of the present invention, which is characterised by the content of the claims set out below and in particular in that it comprises sealing means that separate a (generally rotating) non sterile part of the machine from a (normally fixed) part maintained under sterile conditions and in which the treated containers transit.

Said means comprise a fixed annular channel, at least partly filled with liquid in which a concentric annular element, associated to the rotating part, slides.

The sealing means substantially embody a trap.

The fixed part in which the containers are treated is maintained in overpressure with respect to the exterior environment.

Preferably, a channel is present for each level of the machine in which sealing means are needed and each channel preferably has an overflow device through which any excess liquid is eliminated, and an alarm device connected to a central control unit which, when the measured level of liquid in the channel is lower than a pre-set threshold, activates the injection of additional liquid into the involved channel.

In correspondence with the container entry and/or exit area in the rotary part of the machine, the interruption of a bed or sterile container transport apparatus may be provided, so that it is split in two and completely separated into entry transport apparatus and exit transport apparatus to make said entry and/or exit area accessible.

BEST MODE FOR CARRYING OUT OF THE INVENTION

This and other characteristics shall become more readily apparent from the following description of a preferred embodiment illustrated, purely by way of non limiting example in the accompanying drawing tables, in which:

FIG. 1 schematically shows a plan view of a bottling plant;

Figure 1:
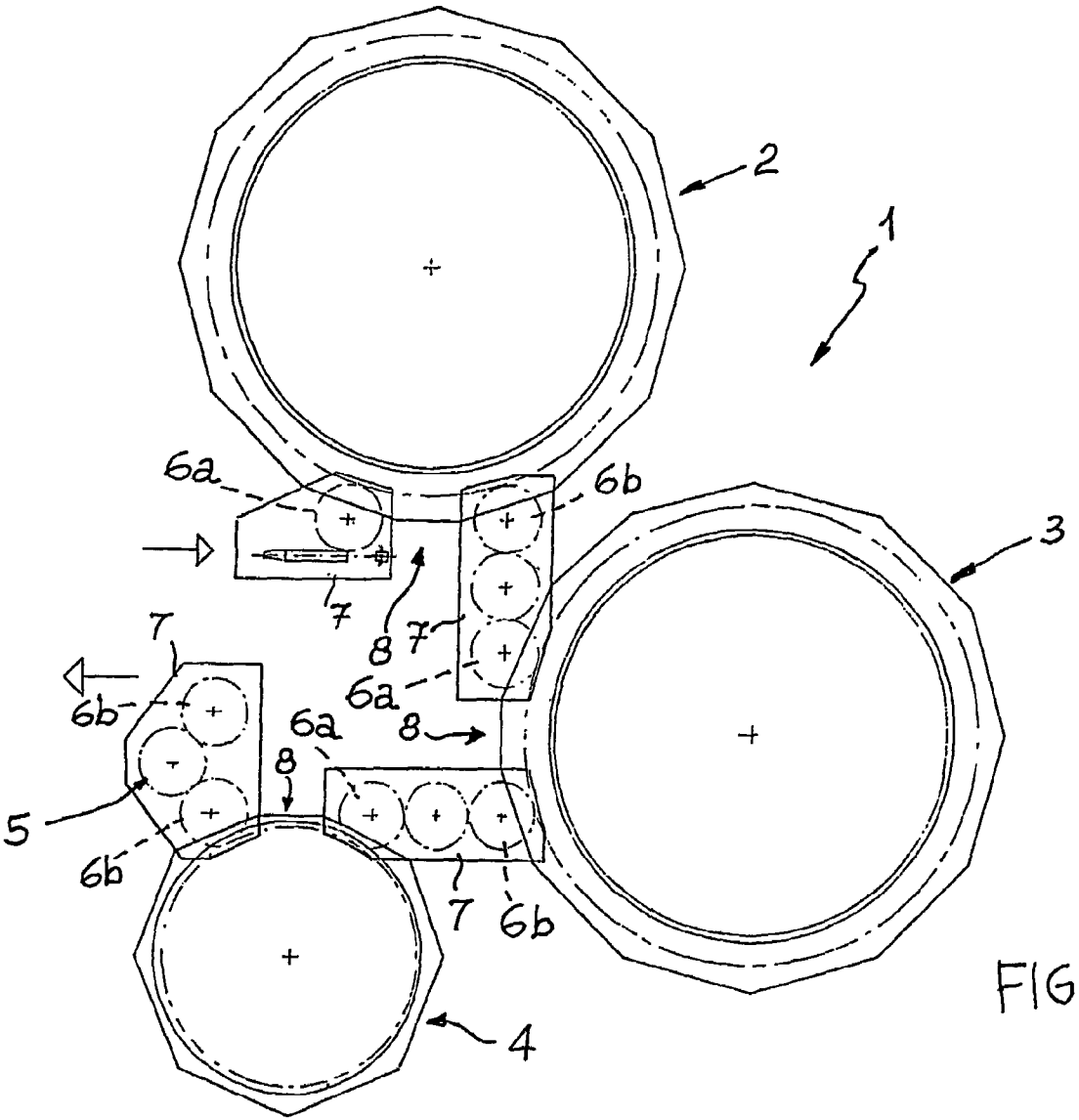

With reference to the figures, the reference number 1 globally indicates an aseptic bottling plant comprising a sterilizing machine 2 (for instance of the type that operates by spraying sterilizing solutions), a rinsing machine 3, a filling machine 4 and lastly a capping machine 5, all or the rotary type.

The containers 10 to be treated arrive at the aforesaid machines by means of entry star conveyors 6*a* and exit therefrom by means of exit star conveyors 6*b*, which are housed in transport apparatuses or beds 7 which are sterile because they are subjected to overpressure conditions with respect to the exterior environment.

Said beds comprise a support base that normally contains the motorisation and the components not under sterile conditions, and supports a tunnel in overpressure conditions within which are the transport elements under sterile conditions.

Figure 2:
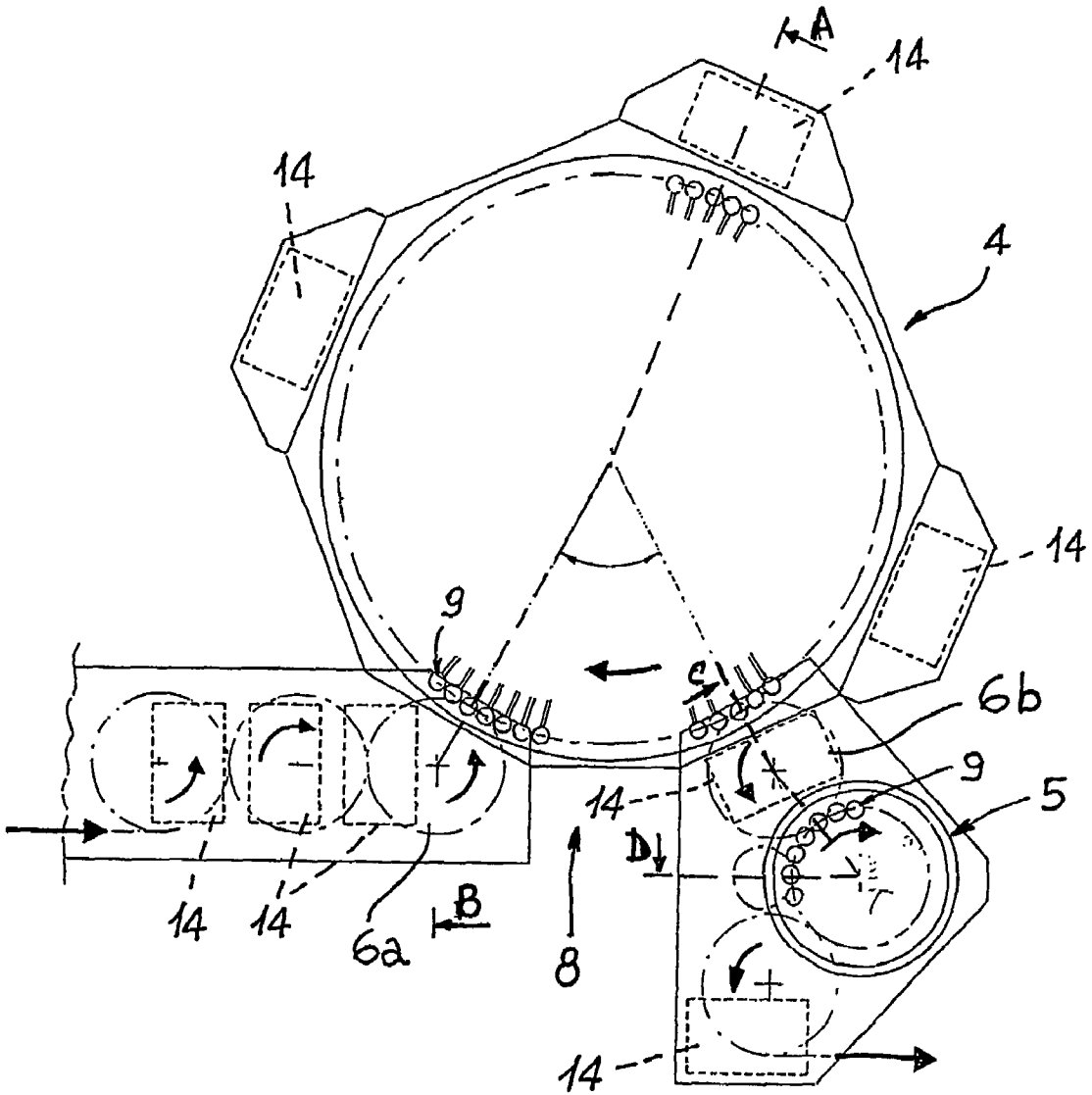
FIG. 2 shows the filling machine—capping machine set in greater detail.
Figure 3:
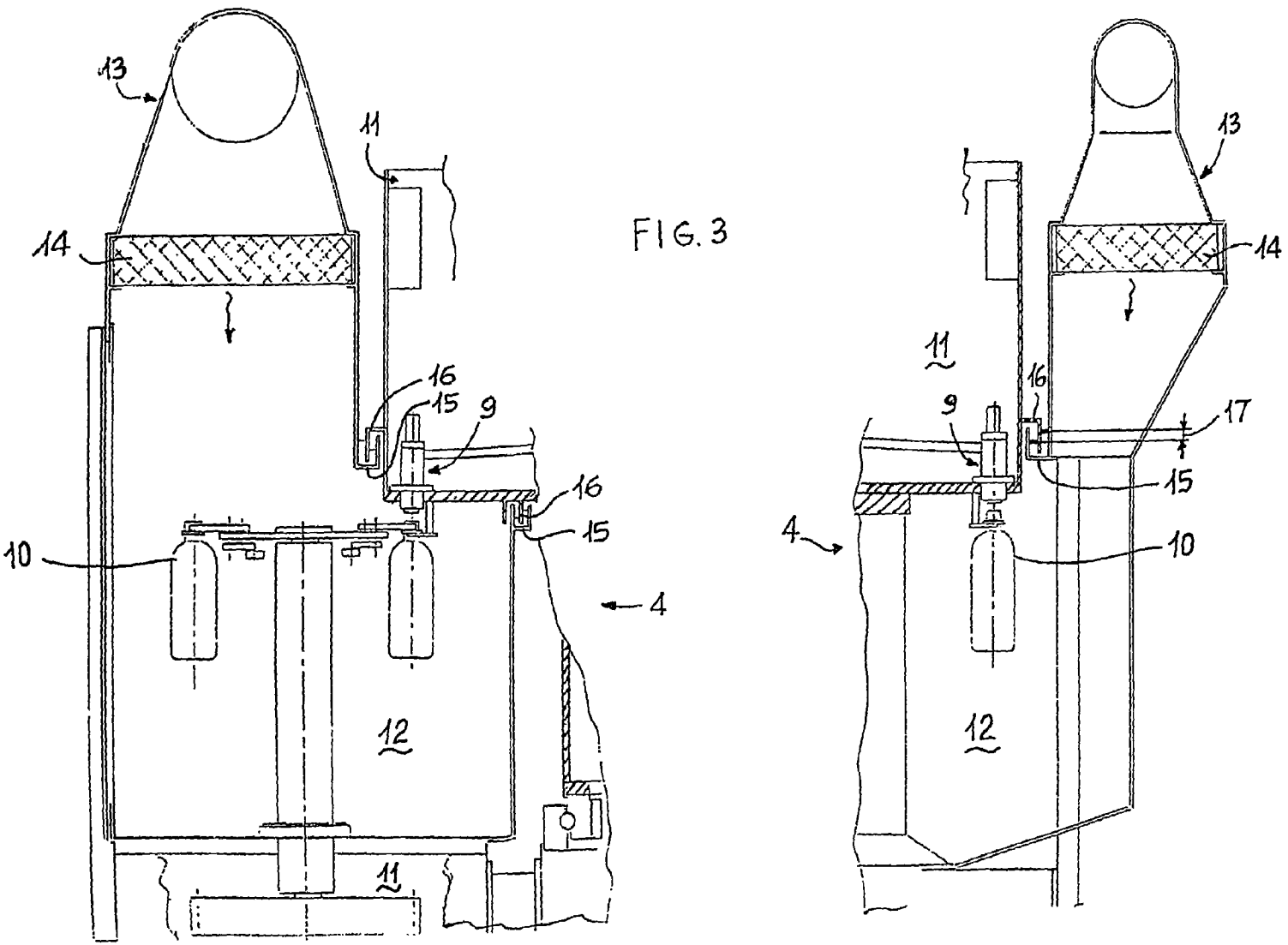
FIG. 3 shows the section A-B of FIG. 2 relating to the filling machine.

Originally, the bed 7 is split in two and completely separated in correspondence with the entry/exit area of the rotating part of the machine to create an area 8 accessible to operators, having a width of about 0.5-1.5 m. With particular reference to FIGS. 2 and 3, a rotary filling machine 4 is illustrated therein, provided with a plurality of stations 9 for the treatment of the containers 10, consisting of filling valves equally spaced on a circumference.

Tangential to the circumference, and synchronised with the rotating platform of the filling machine, are the two start conveyors: the entry conveyor (6*a*) for the empty containers and the exit conveyor (6*b*) for the full containers.

The environment for the treatment or processing of the containers, in the specific case the environment for their filling, is isolated from the exterior environment but allows the entry of the empty containers and the exit of the full containers through appropriate openings, not shown herein, in the walls that circumscribe the aseptic area.

The reference number 11 indicates a non sterile area of the machine (which oftentimes is a rotating part), whereas the number 12 indicates an area under sterile conditions (which oftentimes is a fixed part) in which the treated containers 10 transit.

The part 12 is maintained under sterile conditions as a consequence of an overpressure created in said environment by the insertion of air, fed by conduits 13 through absolute filters 14.

The seal between the non sterile area 11 and the sterile area 12 is originally achieved by means of a fixed annular channel 15 partially filled with a liquid, in which slides a concentric annular element 16 associated in watertight fashion to the rotating part.

The annular element 16 is partly immersed in the liquid of the channel and moves within the channel driven by the rotation of the machine.

The liquid, which preferably is a sterilizing liquid able to eliminate the presence of any bacteria, for instance a water and chlorine solution, acts as an isolator preventing contact between the sterile area and the exterior environment.

Obviously, a channel 15 is present with the respective annular element 16 for each border area between the sterile area and the non sterile area.

Because of the slight overpressure (a few millibar) inside the sterile area 12 or aseptic chamber, a height difference 17 (of a few mm of water column and equal to the overpressure created) is formed the liquid present in the channel 15 situated in contact with the aseptic chamber and the one situated externally to the annular element 16 in contact with the exterior environment.

Figure 4:
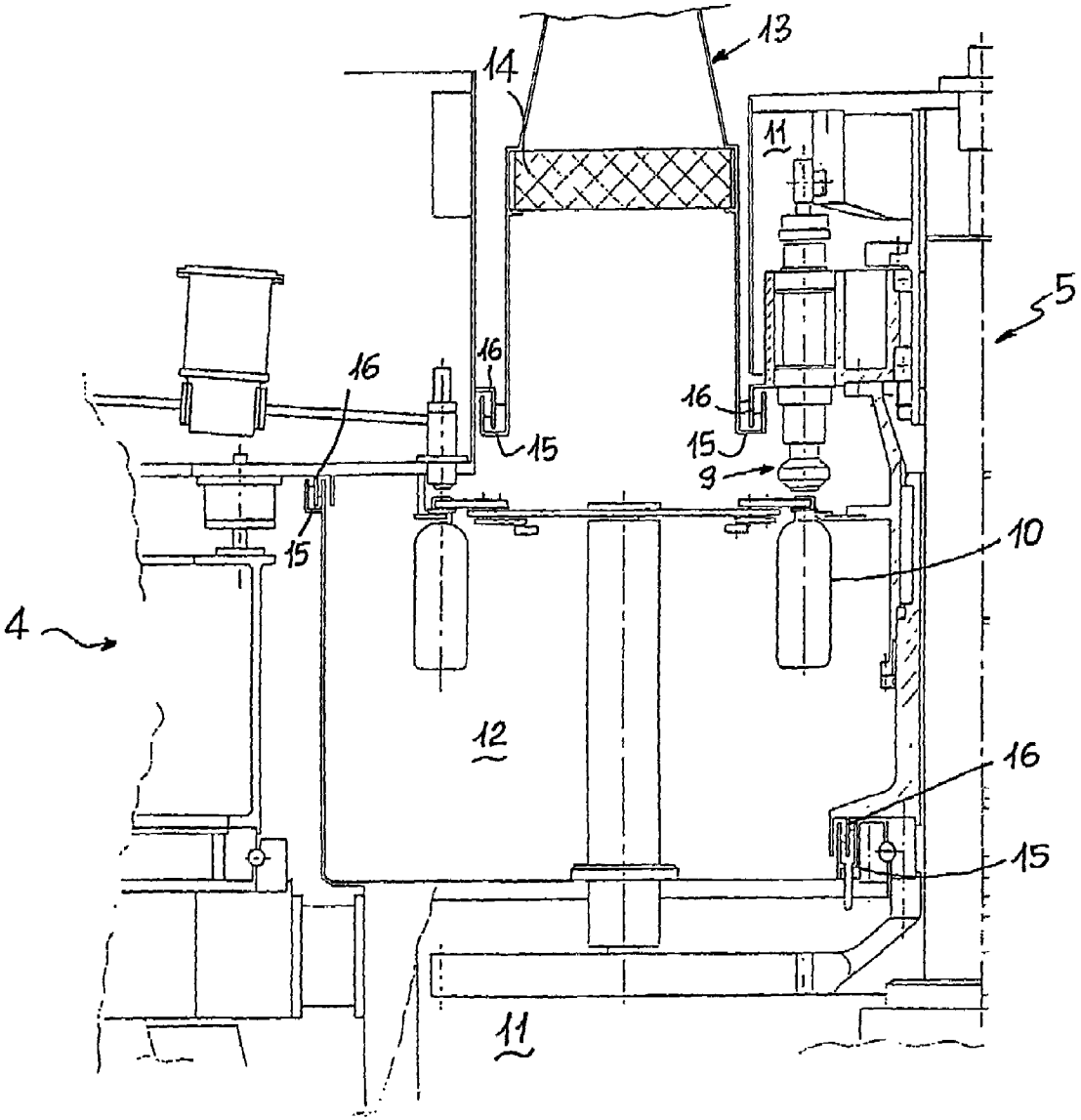
FIG. 4 shows the section C-D of FIG. 2 relating to the star conveyor between the filling machine and the capping machine.

FIG. 4 shows the application of the channels 15 to the capping machine 5 (shown in half section). The figure shows the use of two channels 15 at different levels.

To assure the constant presence of liquid in each channels, a level control system is provided.

Figure 5:
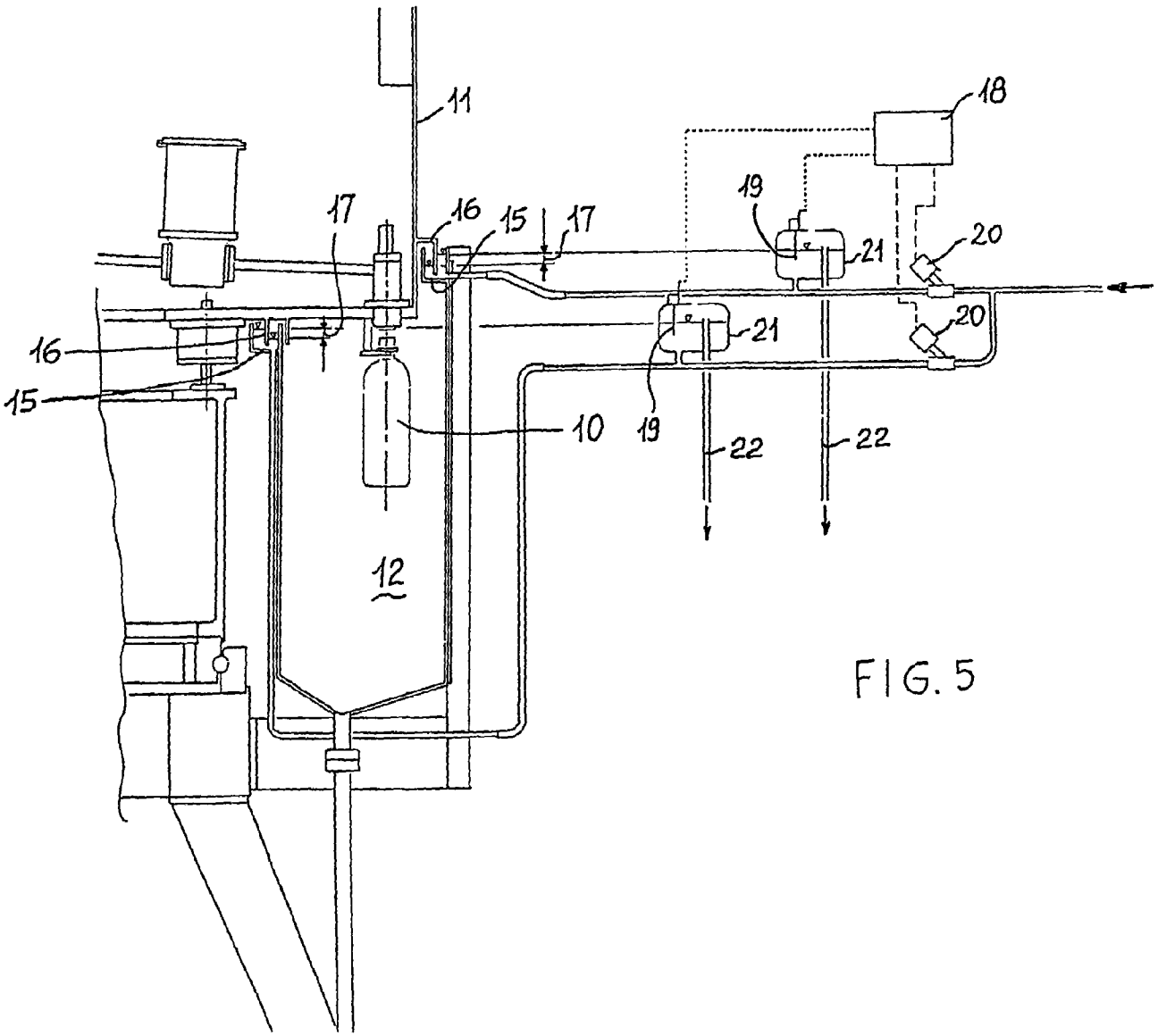
FIG. 5 shows a detail of the sealing means and of the central control unit that controls the liquid in the sealing channels.

Said system, shown in FIG. 5, preferably comprises a single central control unit 18 and, for each channel, a probe 19 for measuring the level immersed in a cup 21 and a regulating valve 20 able to recall additional liquid from a tank, not shown herein, as well as an overflow pipe 22 inserted in the cup and able to allow an automatic outflow of the liquid if a pre-set level (determined by the placement of the pipe itself) is exceeded, to prevent the liquid from spilling inside the aseptic chamber.

In essence, when the level measured by the probe 19 in the cup 21 is lower than a pre-set minimum level, the central control unit controls the inflow of additional liquid into the cup. There is a cup for each channel level, or there may be multiple channels 15 connected to a single cup provided said channels are located at the same height level from the ground.

With the present invention, a perfect seal is obtained between aseptic environment and exterior environment, with sealing means 15, 16, which substantially embody a trap, non subject to wear and with less usage of air than labyrinth seals.

Moreover, the seal is assured regardless of the quality of the mechanical work processes, hence particular and costly working processes are not required for the parts involved with the hermetic seal of the aseptic area.

With the present solution, the only paths for the escape of sterile air from the system, which are inevitable, are only from the doors for the entry and exit of the containers, guaranteeing a more effective control over the conditions of sterility of the system with less usage of sterile air.

The present invention can be applied to any machine included in a bottling plant, such as a sterilizing machine, rinsing machine, filling machine, capsulating/capping machine.

The invention claimed is:

1. Machine for the aseptic treatment of containers (10) in bottling plant, of the rotary type provided with a plurality of stations (9) for treating the containers and so shaped as to cause the treatment of the containers to take place under substantially sterile conditions, comprising:

sealing means that separate a non sterile area (11) of the machine from an area (12) maintained under sterile conditions and in which the treated containers (10) transit, said means comprising a fixed annular channel (15) at least partially filled with liquid in which slides a concentric annular element (16) associated with the rotating part (11);

a level control apparatus to assure the constant presence of liquid in each channel;

wherein in correspondence with the container entry and/or exit area a sterile bed or container transport apparatus (7) is interrupted, thereby being split into an entry transport apparatus and an exit transport apparatus with the definition of an area of accessibility (8) to the entry and/or exit area of the rotating part of the machine.

2. Machine as claimed in claim 1, wherein the liquid is sterile liquid, such as a solution of water with sterilizing substances.

3. Machine as claimed in claim 1, wherein said sealing means embody a trap.

4. Machine as claimed in claim 1, wherein the sterile area (12) is maintained in overpressure with respect to the exterior environment by the insertion of sterile air through absolute filters (14).

5. Machine as claimed in claim 1, wherein a channel (15) is present for each level of the machine in which sealing means are required.

6. Machine as claimed in claim 1, wherein each channel (15) has an overflow device (22) through which excess liquid is eliminated.

7. Machine as claimed in claim 1, wherein the apparatus comprises a level probe (19) for each channel (15) connected to a central control unit (18) which, when a liquid level below a pre-set threshold is measured in the channel, activates the injection of additional liquid into the involved channel.

8. Machine as claimed in claim 1, wherein the sterile area (12) is a fixed part of the machine, whilst the non sterile area (11) is a rotating part of the machine.

9. Machine as claimed in claim 1, wherein the area of accessibility (8) has a width of 0.5-1.5 m.

10. Machine as claimed in claim 1, wherein an overflow pipe (22) allows an automatic outflow of the liquid if a pre-set level is exceeded.

* * * * *